United States Patent [19]

Boichot-Castagne et al.

[11] Patent Number: 4,467,297

[45] Date of Patent: Aug. 21, 1984

[54] MULTI-POLE CIRCUIT BREAKER WITH INTERCHANGEABLE MAGNETO-THERMAL TRIPPING UNIT

[75] Inventors: Bernard Boichot-Castagne, Sassenage; Roger Case, Seyssinet-Pariset; Jackie Pezelet, Uriage, all of France

[73] Assignee: Merlin Gerin, Grenoble Cedex, France

[21] Appl. No.: 373,142

[22] Filed: Apr. 29, 1982

[30] Foreign Application Priority Data

May 7, 1981 [FR] France ..... 81 09296

[51] Int. Cl.[3] ..... H01H 73/06

[52] U.S. Cl. ..... 335/8; 335/42; 335/176

[58] Field of Search ..... 335/21, 23, 35, 42, 335/45, 176, 8, 9, 10, 202

[56] References Cited

U.S. PATENT DOCUMENTS 3,211,860 10/1965 Stephenson, Jr. et al. .

3,260,822 7/1966 Stephenson et al. ..... 335/42

3,264,435 8/1966 Klein et al. .

FOREIGN PATENT DOCUMENTS 1107797 3/1959 Fed. Rep. of Germany ..... 335/42

1423090 11/1964 France .

*Primary Examiner*—J. D. Miller

*Assistant Examiner*—George Andrews

*Attorney, Agent, or Firm*—Parkhurst & Oliff

[57] ABSTRACT

The present invention relates to a multi-pole circuit breaker with an interchangeable magneto-thermal tripping unit electrically and mechanically connected to the breaker unit by means of connecting screws. The connecting lugs of the breaker unit are positioned with vertical play in transverse slots in the breaker unit casing and are electrically connected to the movable contacts by flexible connections. When the connecting screws are tightened the breaker unit connecting lugs are shifted to bear on the associated tripping unit lugs irrespective of any positioning defects. A reset spring of the electro-magnetic tripping device is anchored on one end on the armature and on the other end to the tripping device adjusting bar.

8 Claims, 8 Drawing Figures

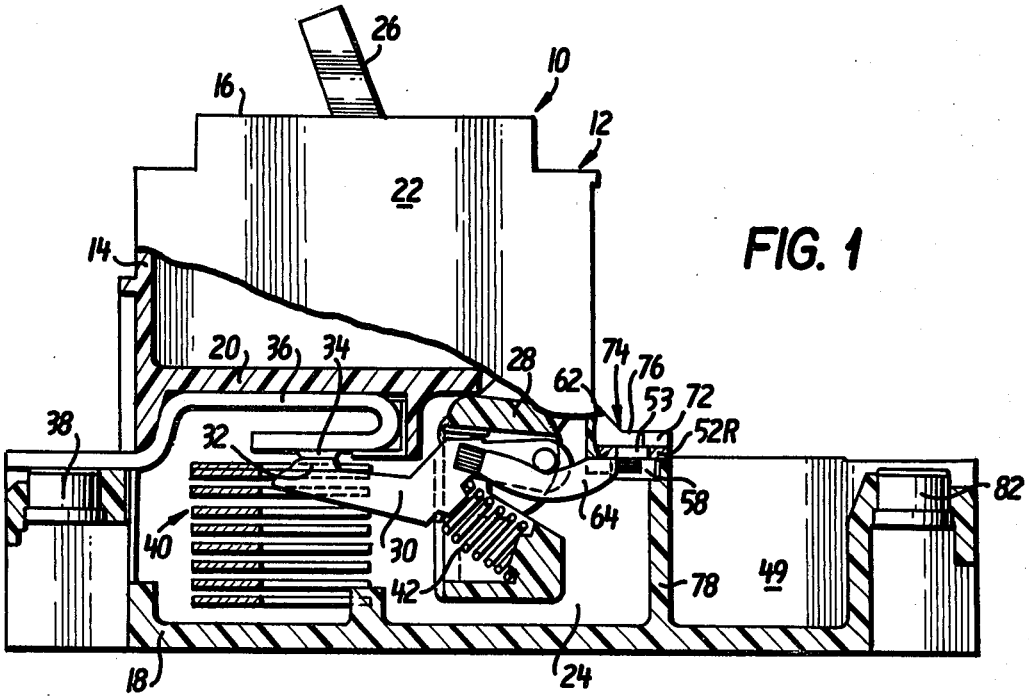
FIG. 1
FIG. 2
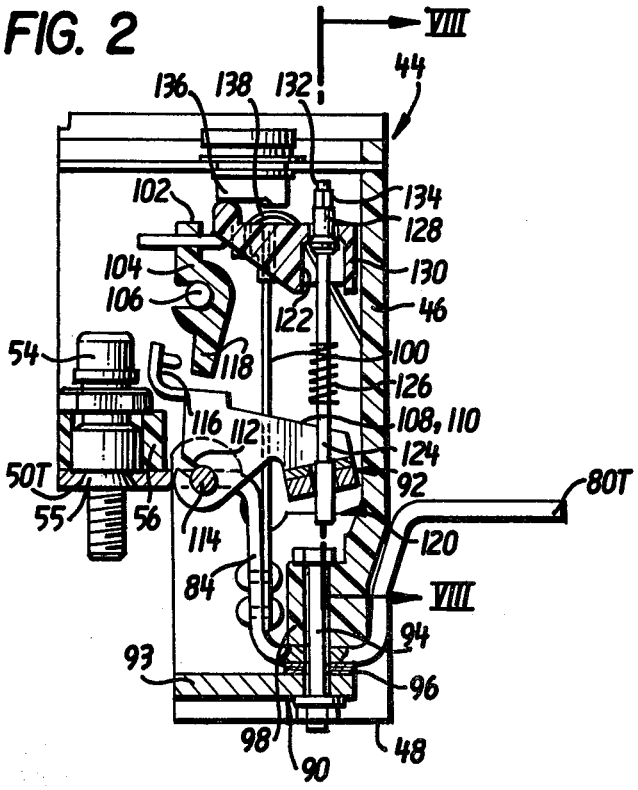
FIG. 8
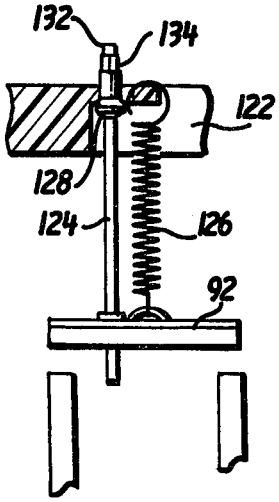

MULTI-POLE CIRCUIT BREAKER WITH INTERCHANGEABLE MAGNETO-THERMAL TRIPPING UNIT

BACKGROUND AND SUMMARY OF THE INVENTION

This invention relates to a low voltage, multi-pole electric circuit breaker built up by the modular assembly of a breaker unit in a molded insulating box divided into a number of adjacent pole units, and a magneto-thermal tripping unit that is interchangeable according to the selected rating. Each pole of the breaker unit includes a pair of separable contacts, namely a stationary contact linked to an upstream connection terminal of the circuit breaker and a moving contact linked electrically to a connecting strip able to be superimposed in contact with a connecting strip of the tripping unit, the box of which is mounted to rest on the box of the breaker unit. The tripping unit includes thermal and electromagnetic tripping components and is governed by the current flowing in a conductor in line with the pair of contacts in the lengthwise direction of the pole unit. The tripping unit connecting strip is arranged at one of the ends of the conductor while the other end of the conductor is fixed to the downstream connection terminal of the circuit breaker. The electrical continuity at each pole between the conductor of the tripping unit and the pair of contacts of the breaker unit is obtained by means of a connecting screw ensuring the tight contact of the two intermediate tripping and breaker connecting strips when they are superimposed.

It is traditional practice to use a set of magneto-thermal tripping units with different tripping characteristics that can be selectively associated with the sale standard breaker unit in order to constitute circuit breakers having different ratings. A defective tightening of the connecting screw on mounting the tripping unit may give rise to overheating that is detrimental to the proper working of the circuit breaker.

According to a known device of the kind described, the connecting strip of each pole of the breaker unit bears on a stationary contact stud fixed to the base, which contact stud comprises a tapped opening to cooperate with the connecting screw when the pair of tripping unit and breaker unit connecting strips are connected in the superimposed position. It is found that faults in the positioning of the breaker unit and the tripping unit on top of each other, generally due to molding flaws in the plastic, can lead to insufficient tightening of a connecting screw at one of the poles, since all the tapped openings of the stationary contact studs are arranged in the same plane.

To allow for such flaws, a previous improvement has proposed the use of deformable flexible connecting strips of the tripping and/or breaker unit such that their flexibility ensures the appropriate tight contact of the strips when the tripping unit is mounted. However, strips of this type, deformable in design by superimposing conducting foils, are expensive to produce and inadequate for high rating circuit breakers.

The object of this invention is to eliminate these disadvantages and to provide a circuit breaker with an interchangeable tripping unit having a reliable electrical connection whatever the variations in level between the boxes of the breaker unit and the tripping unit.

A feature of a circuit breaker according to the invention is that a flexible connection of the arm of the moving contact is fixed directly to the connecting strip of each pole, which comprises one contact surface cooperating with the corresponding tripping unit connecting strip, while the opposite surface is fitted with a nut, and each breaker unit connecting strip is positioned with vertical play in a transverse slot in the box of the breaker unit; when the connecting screw inserted in the nut is tightened with the tripping unit in the mounted position on the box, it bears on the said floating strip in the direction of the aforementioned play so as to ensure a good electrical contact with the corresponding tripping unit connecting strip, irrespective of any defects in the positioning of the boxes.

According to a development of the invention, the interchangeable tripping unit comprises for each pole an electromagnetic tripping device governed by the current flowing in a conductor in line with the pair of contacts, the tripping unit including a U-shaped magnetic curcuit through which the conductor runs, that cooperates with a moving ferromagnetic vane. This vane is drawn back by a return draw spring anchored at the other end to a bar adjusting the air gap. The air gap is varied by means of a spacer rod linked between the adjusting bar and the vane and lying parallel to the return spring at a small distance away.

Due to the spacer rod, the air gap can be adjusted at the works and the forces exerted by the return spring on the adjusting bar are cancelled out. Due to the relative position of the spacer rod and the spring, any change in the air gap of the electromagnetic tripping unit will result in a constant pulling force of the return spring.

BRIEF DESCRIPTION OF THE DRAWINGS

Other advantages and features of the invention will be best understood from the following description of one embodiment of the invention, given as a typical but non-exhaustive example, and illustrated in the attached drawings, in which:

FIG. 1 is a schematic view of a partially opened up breaker unit in a circuit breaker according to the invention, shown in the closed position;

FIG. 2 is a sectional view of the tripping unit along line II—II in FIG. 6;

FIG. 8 is a partial sectional view of an electromagnetic tripping component along ling VIII—VIII shown in FIG. 2.

DETAILED DESCRIPTION OF THE PREFERRED EMBODIMENT

Figure 3:
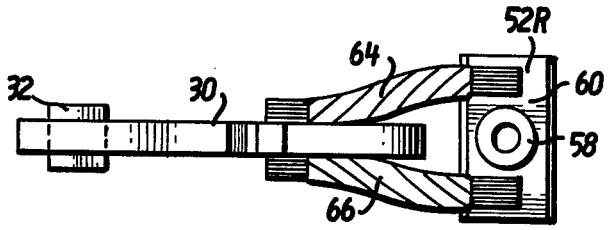
FIGS. 3 and 4 are views from below and in elevation of a moving contact arm associated with a breaker connecting strip according to the invention.

In FIG. 1, a breaker unit 10 of a low voltage, multi-pole electric circuit breaker, in particular a quadripolar circuit breaker protecting a 3-phase+neutral mains supply, is housed in a box 12 of molded insulating material which is an assembly of an intermediate casing 14, a lid 16 for and top and a base-plate 18 or base cover for the bottom. The intermediate casing 14 includes a middle partition 20 dividing the inner space of box 12 into two superposed compartments, one at the top 22 and the other at the bottom 24 and isolated from each other.

Lid 16, casing 14 and base 18 are fixed together by assembly accessories (not illustrated). An opening is provided in the top of the lid 16 to accommodate an operating lever 26 for the control mechanism (not illustrated) in the top compartment 22. The four identical poles of breaker unit 10 are placed side by side in bottom compartment 24 along planes parallel to that in FIG. 1. The control mechanism common to all the poles is conveniently associated with an intermediate pole so that the movement is transmitted to all the adjacent poles by means of an actuating bar 28 fixed to the contact arm 30 of each pole. Transverse bar 28 is housed in bottom compartment 24 and lies perpendicular to the different contact arms 30 which are actuated simultaneously when bar 28 moves between the open and closed positions of the circuit breaker.

In each pole of breaker unit 10, the moving contact arm 30 bears a contact 32 cooperating in the closed position with a stationary contact 34 fixed to a conductor 36 forming a loop connected electrically with a connection terminal 38. Each pair of stationary 34 and moving 32 contacts has a corresponding arc extinguishing device (40) with deionization plates arranged in the bottom compartment 24 between conductor 36 carrying stationary contact 34 and base plate 18. A compression spring 42 inserted between bar 28 and contact arms 30 provides the appropriate contact pressure in the closed position of contacts 32, 34.

The circuit breaker opens in the traditional way by a counterclockwise rotation of bar 28 actuated by the control mechanism operated manually via lever 26 and automatically by a magneto-thermal tripping unit 44. Each pole of the circuit breaker has a corresponding thermal component and electromagnetic component housed in tripping unit 44 to trip the circuit breaker respectively on an overload current or a short circuit.

The magneto-thermal tripping unit 44 (FIGS. 2 and 6 to 8) is interchangable depending on the selected rating of the circuit breaker, and it is housed in a box 46 in molded insulating material with an open bottom end 48. The number of poles of the tripping unit 44 corresponds to that of breaker unit 10, and a set of removable tripping units 44 of identical design, but with different tripping characteristics, is used in conjunction with the same breaker unit 10 to form circuit breakers having different ratings.

Consequently, each circuit breaker is built up by a modular assembly of the standard breaker unit 10 and a previously defined tripping unit 44.

Figure 4:
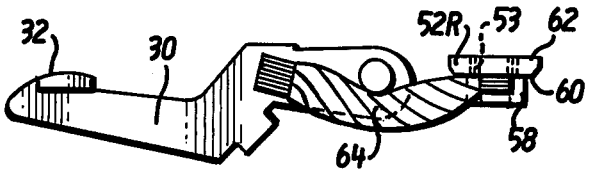

The open end 48 of tripping unit 44 is fitted in a housing 49 in base 18 of breaker unit 10. Its connecting strips or lugs 50R, 50S, 50T, 50N are then in superimposed contact with connecting strips or lugs 52R, 52S, 52T, 52N of the corresponding poles of breaker unit 10. The electrical continuity of units 10 and 44 when assembled together is obtained by means of a connecting screw 54 which goes through the aligned holes 55, 53, provided respectively in each pair of superimposed strips 50R, 52R; 50S 52S; 50T, 52T; 50N, 52N. The head of each screw 54 is carried by a transverse rim 56 of box 46 while the opposite side of rim 56 carries the stationary connecting strips 50R to 50N of tripping unit 44. A nut 58 that cooperates with screw 54 on tightening is fixed to the under side 60 of each strip 52R, 52S, 52T, 52N of breaker unit 10, the opposite surface 62 being in contact with the corresponding strip 50R, 50S, 50T, 50N of unit 44. Two connecting flexes 64, 66 or parallel connections (FIGS. 3 to 5) are welded to the under side 60 of each strip 52R to 52N and to the moving contact arm of the corresponding pole. The connecting strip 52R to 52N of each pole is positioned with play in a transverse slot 68 in intermediate casing 14 (see lefthand side view FIG. 5). The upper limit of slot 68 is a stop formed by two rims 70, 72, provided in flanges 74 of casing 14 at the level of the partitions separating two adjacent poles. The upper shoulders 76 of flanges 74 of casing 14 are constituted as bearing surfaces for tripping unit 44, while the box of unit 44 is set on edge on the opposite side walls of base 18.

Figure 5:
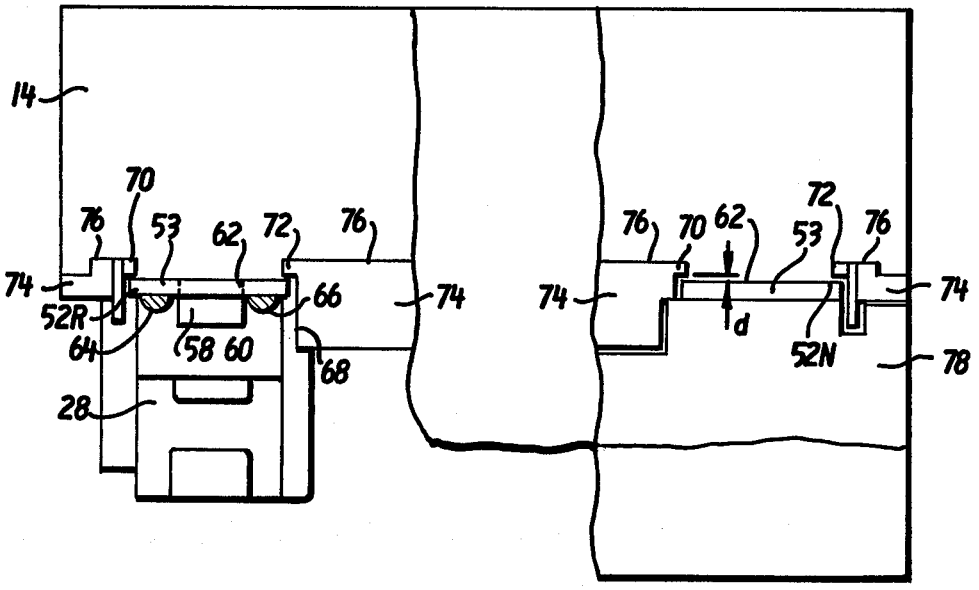
FIG. 5 is a side view of the breaker unit, the lefthand and righthand sides representing the unit without and with the base, respectively.
Figure 6:
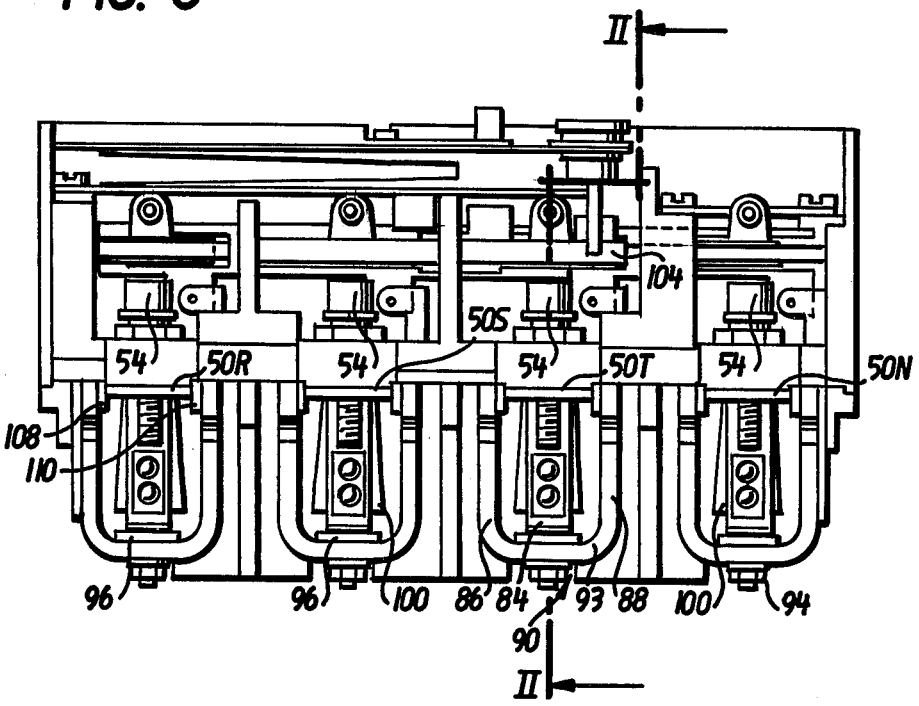
FIG. 6 is a side view of the tripping unit.
Figure 7:
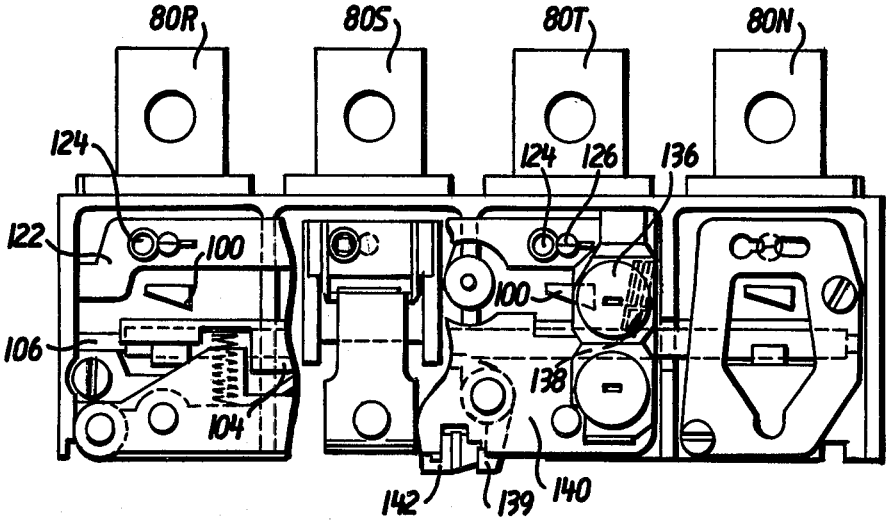
FIG. 7 is a plan view of FIG. 6.

When the intermediate casing 14 is placed on base 18, each connecting strip 52R, 52S, 52T, 52N comes to bear on the edge of a transverse partition wall 78 in housing 49 (see righthand side view, FIG. 5). There is a preset clearance d above the contact surface 62 of each strip 52R to 52N and rims 70, 72. This results in a floating mounting of connecting strips 52R to 52N of breaker unit 10 when the boxes on base 18 and the intermediate housing are fitted together.

The tripping unit 44 has connecting strips 80R, 80S, 80T, 80N that cooperate with stationary contact studs 82 housed in base 18 to constitute the downstream connection terminals of the circuit breaker, while the upper terminals 38 are connected directly to stationary contacts 34 of the corresponding poles in breaker unit 10. When tripping unit 44 is inserted in housing 49, shoulders 76 of the intermediate casing 14, opposite side walls of base 18 and contact studs 82 position the height of unit 44 and any differences in level or distortion of the plastic molding results in an imperfect positioning. The floating mounting of each connecting strip 52R to 52N in clearance d can allow for such flaws in the molding of box 46 of tripping unit 44 and of box 12 of breaker unit 10 and therefore ensure a reliable electrical connection at each pole. When connecting screws 54 are tightened, each floating strip 52R to 52N of breaker unit 10 is forced upwards so that its contact surface 62 is pressed against the corresponding stationary connecting strip 50R to 50N of tripping unit 44.

The tripping components (FIGS. 2 and 6 to 8) of the pole units is tripping unit 44 are identical and in the following only one of them will be described, namely the one corresponding to phase T. Connecting strip 50T and connecting strip 80T are linked together by a conductor 84 running lengthwise through tripping unit 44 in line with the pair of contacts 32, 34 of the corresponding pole in breaker unit 10. The pole current flows through conductor 84 which is inserted between branches 86, 88 of a U-shaped magnetic circuit 90 that cooperates with a moving vane 92 in ferro-magnetic material to constitute the electromagnetic tripping componet sensitive to short-circuit currents. Conductor 84 is curved into a U with its middle part held flat against base 93 of magnetic circuit 90 by means of assembly bolt 94. An insulating washer 96 is placed between base 93 and conductor 84 and the head of bolt 94 rests on a flange 98 of box 46. The middle part of conductor 84 is therefore trapped between magnetic circuit 90 and box 46.

The thermal tripping component comprises a long bimetallic element 100 secured by rivets to conductor 84. Bimetallic element 100 lies practically in the vertical mid plane between strips 50T and 80T and is heated indirectly by conduction when the current flows in conductor 84. The free end of bimetallic element 100 when sufficiently deflected cooperates with a finger 102 carried by a common main tripping bar 104. This bar is mounted with limited swivel on pin 106 and positioned transversely in box 46 in the direction of bar 28.

Pivoting vane 92 of the electromagnetic tripping component has two side wings 108, 110 fitted between the two branches 86, 88 of U-shaped magnetic circuit 90. The end of each wing 108, 110 comprises a half-open notch 112 engaged on a rigid dowel protruding inwards from the corresponding branch 86, 88 to form the hinge of vane 92. A control lug 116 fixed to vane 92 can cooperate with extension 118 of main tripping bar 104 when the mangetic field generated by a short-circuit current in conductor 84 causes vane 92 to be attracted against end pole surface 120 of branches 86, 88 of magnetic circuit 90.

An adjusting bar 122 of the electromagnetic tripping threshold lies parallel to the tripping bar 104 above vane 92 and is swivel mounted in bearings of box 46 in order to vary the air gap provided between vane 92 and the corresponding pole surface 120. A spacer rod 124 (FIGS. 2 and 8) forms a one-way link between adjusting bar 122 and moving vane 92 to transmit the adjusting movement of bar 122 to vane 92 without obstructing the electromagnetic attraction of the vane against pole surface 120 when a short-circuit occurs.

A draw spring 126 anchored between adjusting bar 122 and each moving vane 92 lies parallel to and a short distance away from the corresponding spacer rod 124 and draws moving vane 92 away from pole surface 120 into the inactive position. One of the ends of spacer rod 124 is mechanically secured to moving vane 92 and its other end carries an endpiece 128 that rests on a bearing surface 130 of adjusting bar 122. Endpiece 128 is extended by a threaded rod 132 protuding from bar 122 and cooperating with a nut 134 to constitute a means of adjusting the length of spacer rod 124 to constitute a factory adjustment of the air gap.

The swivel of adjusting bar 122 of the air gap of magnetic circuits 90 is controlled by user's adjustment knob 136 of the electromagnetic tripping threshold (FIG. 2). A torsion spring 138 (FIG. 2) has a clockwise action on bar 122 to bear against knob 136.

Main tripping bar 104 receives the impulses of bimetallic element 100 and vane 92 respectively when an overload current or a short-circuit current occurs, and cooperates with latch 139 of an energy storage device 140 with a hammer 142 that triggers the automatic tripping of the control mechanism of breaker unit 10 to open the circuit breaker contacts.

The operation of one pole unit in the electromagnetic tripping unit, the factory adjustment and user's adjustment of the electromagnetic tripping threshold, take place as follows:

The factory adjustment of the threshold is carried out with vane 92 in the withdrawn position by varying the length of spacer rod 124 by means of the adjustable endpiece 134. In addition, the spacer rod 124 cancels out the forces exerted by return spring 126 on adjusting bar 122.

Once the length of spacer rod 124 is set, the user can adjust the threshold by turning adjusting knob 136 to pivot adjusting bar 122 in the required direction. This bar drives endpiece 128 on spacer rod 124 to bring vane 92 closer to or further away from pole surface 120, depending on whether the air gap is to be increased or reduced. While the air gap is being adjusted in this way, draw spring 126 is braced against the preset length of spacer rod 124 and vane 92 is then subjected to a return force of constant power for the required tripping threshold.

When a short-circuit current occurs in the pole, vane 92 is drawn by electromagnetic attraction against pole surface 120 of magnetic curcuit 90 once the threshold set by the air gap is exceeded. This causes a counterclockwise swivel (FIG. 2) of the main tripping bar 104 driven towards the tripped position by means of control lug 116 of moving vane 92. As it travels drawn by electromagnetic attraction, vane 92 drives spacer rod 124 downwards due to the vertical movement of endpiece 128 in the opening limited by bearing surface 130 of adjusting bar 122. Adjusting bar 122 remains practically stationary since endpiece 128 abandons bearing surface 130 when vane 92 is in its attracted position.

Main tripping bar 104 and adjusting a 122 of the electro-magnetic tripping threshold are located on either side of the vertical mid-plane occupied by bimetallic elements 100 which are not affected by heating at the connections of strips 50R to 50N, 80R to 80N, of tripping unit 44.

Naturally the invention is in no way limited to the embodiment as described and as illustrated on the drawings, but includes any other alternative design based on equivalent electrotechnical provisions, in particular in which each connecting strip 50R, 50S, 50T, 50N of tripping unit 44 instead of being stationary (as on FIGS. 1 to 8) would have a floating mounting in box 46 in order to cooperate with either floating or rigid connecting strip 52R, 52S, 52T, 52N of the corresponding pole in breaker unit 10.

What is claimed is:

1. A multi-pole circuit breaker comprising a breaker unit having a molded insulating box and a plurality of pole units supported within said box, and a magnetothermal tripping unit interchangeable according to the selected rating and including a molded insulating box which is mounted to rest on the box of the breaker unit, each pole unit of the breaker unit comprising a stationary contact and a movable contact, an upstream connection terminal of the circuit breaker connected to the stationary contact and a connecting lug connected through an electrical connection to the movable contact, said tripping unit comprising, for each of said pole units, thermal and electromagnetic trip means to operate upon the occurrence of certain current conditions for effecting tripping of the circuit breaker, a downstream connection terminal of the circuit breaker and a connecting lug, said trip means being connected in series between the downstream connection terminal and the connecting lug, wherein the connecting lug of the breaker unit is positioned with play within the box of the breaker unit, the electrical connection between the movable contact and the connecting lug being flexible to allow shifting of the connecting lug relative to the box, the connecting lug of the breaker unit and the connecting lug of the tripping unit being superimposed in the mounted position of the tripping unit box on the box of the breaker unit, said circuit breaker including, for each pole unit, a connecting screw shifting the connecting lug of the breaker unit to bear on the tripping unit connecting lug irrespective of any defects in the positioning of the boxes.

2. The mult-pole circuit breaker according to claim 1, wherein the connecting lug of the breaker unit has two surfaces, one of said surfaces bearing on the associated tripping unit connecting lug and an opposite surface fitted with a nut of said connecting screw.

3. The multi-pole circuit breaker according the claim 2, wherein the box of the breaker unit has slots receiving with play the breaker unit connecting lugs and flanges on which bears the tripping unit box in the mounted position, each flange including a slot receiving with play the breaker unit connecting lug and two rims which define the slot on a side of the tripping unit, the tripping unit connecting lug protruding between said rims.

4. The mult-pole circuit breaker according to claim 1, wherein the connecting lug of the breaker unit is positioned with vertical play.

5. A multi-pole circuit breaker comprising a breaker unit having a molded insulating box and a plurality of pole units supported within said box, and a magneto-thermal tripping unit interchangeable according to the selected rating and including a molded insulating box which is mounted on the box of the breaker unit in a mounted position and which is removed from the box of the breaker unit in a removed position, each pole unit of the breaker unit comprising a stationary contact and a movable contact, an upstream connection terminal of the circuit breaker connected to the stationary contact and a connecting lug connected by means of a conductor to the movable contact, said tripping unit comprising, for each of said pole units, thermal and electromagnetic trip means to operate upon the occurrence of certain current conditions for effecting tripping of the circuit breaker, a downstream connection terminal of the circuit breaker and a connecting lug, said trip means being connected in series between the downstream connection terminal and the connecting lug, wherein the connecting lug of the breaker unit comprises a nut and is positioned with play within the box of the breaker unit, said conductor between the movable contact and the connecting lug being flexible to allow shifting of the connecting lug relative to the box, the connecting lug of the breaker unit and the connecting lug of the tripping unit being superimposed in the mounted position of the tripping unit box on the box of the breaker unit, said circuit breaker including, for each pole unit, a connecting screw threaded in said nut for shifting the connecting lug of the breaker unit to bear on the tripping unit connecting lug irrespective of any defects in the positioning of the boxes.

6. The multi-pole circuit breaker according to claim 5, wherein the box of the breaker unit has slots receiving with play the breaker unit connecting lugs and flanges on which bear the tripping unit box in the mounted position, each flange including a slot receiving with play the breaker unit connecting lug and two rims which partially close the slot in the direction of the tripping unit so as to restrain the breaker unit connecting lug inside the slot, the tripping unit connecting lug protruding between said rims.

7. The multi-pole circuit breaker of claim 5, wherein the connecting lug of the breaker unit is positioned with vertical play within the box of the breaker unit.

8. The multi-pole circuit breaker of claim 5, wherein the connecting lug of the circuit breaker unit is positioned with play in the box of the breaker unit in the mounted position of the trip unit on the circuit breaker unit and in the removed position of the trip unit.

* * * * *